US009538791B2

(12) United States Patent
O'Donnell

(10) Patent No.: US 9,538,791 B2
(45) Date of Patent: Jan. 10, 2017

(54) SHIRT GARMENT WITH HIDDEN BUTTON

(71) Applicant: JOHNNIE-O, Santa Monica, CA (US)

(72) Inventor: John O'Donnell, Santa Monica, CA (US)

(73) Assignee: JOHNNIE-O, Santa Monica, CA (US)

( * ) Notice: Subject to any disclaimer, the term of this patent is extended or adjusted under 35 U.S.C. 154(b) by 236 days.

(21) Appl. No.: 14/084,382

(22) Filed: Nov. 19, 2013

(65) Prior Publication Data

US 2015/0135399 A1 May 21, 2015

(51) Int. Cl.

*A41B 3/00* (2006.01)
*A41B 3/02* (2006.01)
*A41B 1/10* (2006.01)

(52) U.S. Cl.

CPC . *A41B 3/02* (2013.01); *A41B 1/10* (2013.01); *A41B 2300/30* (2013.01)

(58) Field of Classification Search

CPC ..... A41B 1/00; A41B 1/08; A41B 1/10; A41B 3/02; A44B 1/00; A44B 5/007
USPC ..... 2/252, 266
See application file for complete search history.

(56) References Cited

U.S. PATENT DOCUMENTS 139,937 A * 6/1873 Wieser ..... A41B 1/02 2/118
270,087 A * 1/1883 Lynch et al. ..... A41B 1/10 2/128
329,055 A * 10/1885 Lane ..... A41F 5/00 2/229
782,125 A * 2/1905 Gentry ..... A41D 1/02 2/270
2,686,915 A * 8/1954 Gatto ..... A41B 1/10 2/128
4,825,472 A * 5/1989 Garafano ..... A41B 1/16 2/115
7,992,222 B1 * 8/2011 Behrens ..... A41B 1/00 2/118
8,407,817 B2 * 4/2013 Behrens ..... A41B 1/00 2/118
2007/0028368 A1 * 2/2007 Morton ..... A41F 1/00 2/265
2010/0325775 A1 * 12/2010 Fattal ..... A41F 1/004 2/128
2012/0204308 A1 * 8/2012 Pascuzzi ..... A41F 1/004 2/69

FOREIGN PATENT DOCUMENTS

DE 202012005828 U1 * 7/2012
JP 2000093208 A * 4/2000

OTHER PUBLICATIONS

Nielsen, Megan. "Quick Fix: Gaping Blouse." Megan Nielsen Design Diary. WordPress, Aug. 2, 2012. Web. Apr. 5, 2016. <http://blog.megannielsen.com/2012/08/quick-fix-gaping-blouse/>.*

* cited by examiner

*Primary Examiner* — Sally Haden
(74) *Attorney, Agent, or Firm* — One LLP

(57) ABSTRACT

A garment having a collar, the garment comprising: a placket, extending the length of the garment and having spaced apart first and a second buttons substantially nearer to the collar than a third button; wherein a portion of the placket intermediate the first and second button comprises a fly-front placket hiding an intermediate button therein; and wherein a remaining portion of the placket is not a fly front placket.

1 Claim, 2 Drawing Sheets

SHIRT GARMENT WITH HIDDEN BUTTON

BACKGROUND OF THE INVENTION

Figure 1:
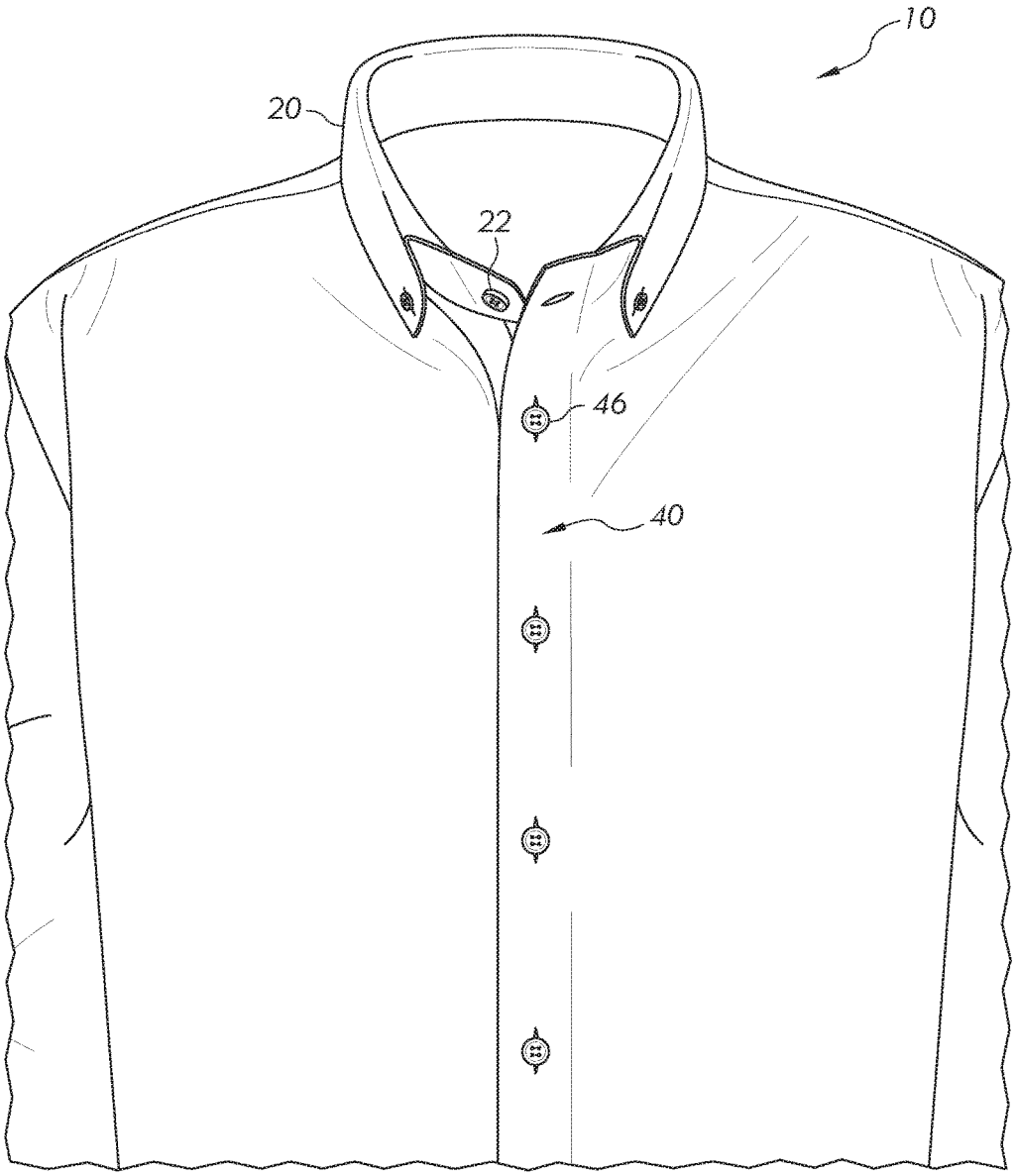

Business casual is an increasingly viable mode of dress. For most, business casual includes a button down collared shirt or blouse. The top buttons of these garments are often left unsecured, so as to leave open the collar area for a more casual appearance, even while wearing business attire.

However, often times, the placement of the buttons on the garment are not custom to the wearer. This may lead to an uncomfortable situation. If the wearer is too buttoned up—i.e. one too many buttons are buttoned—he/she may project the appearance of being uptight or stuffy. If the wearer is too buttoned down—i.e. one too few buttons are buttoned—he/she may be seen as sloppy. This is particularly troublesome where being too buttoned down exposes an inappropriate amount of chest hair or cleavage. But, if one were to simply add more buttons to a shirt or blouse, the resultant look would be aesthetically unpleasing simply due to the excess number of buttons.

It is therefore desirable to provide garments having hidden intermediate buttons between the topmost exposed buttons that will permit wearers to be optimally unbuttoned.

SUMMARY OF THE INVENTION

A collared shirt is described herein that overcomes the limitations noted above.

The collared shirt has a placket with spaced apart first and a second buttons, wherein a portion of the placket intermediate the first and second button is a fly-front placket for hiding an intermediate button.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Figure 2:
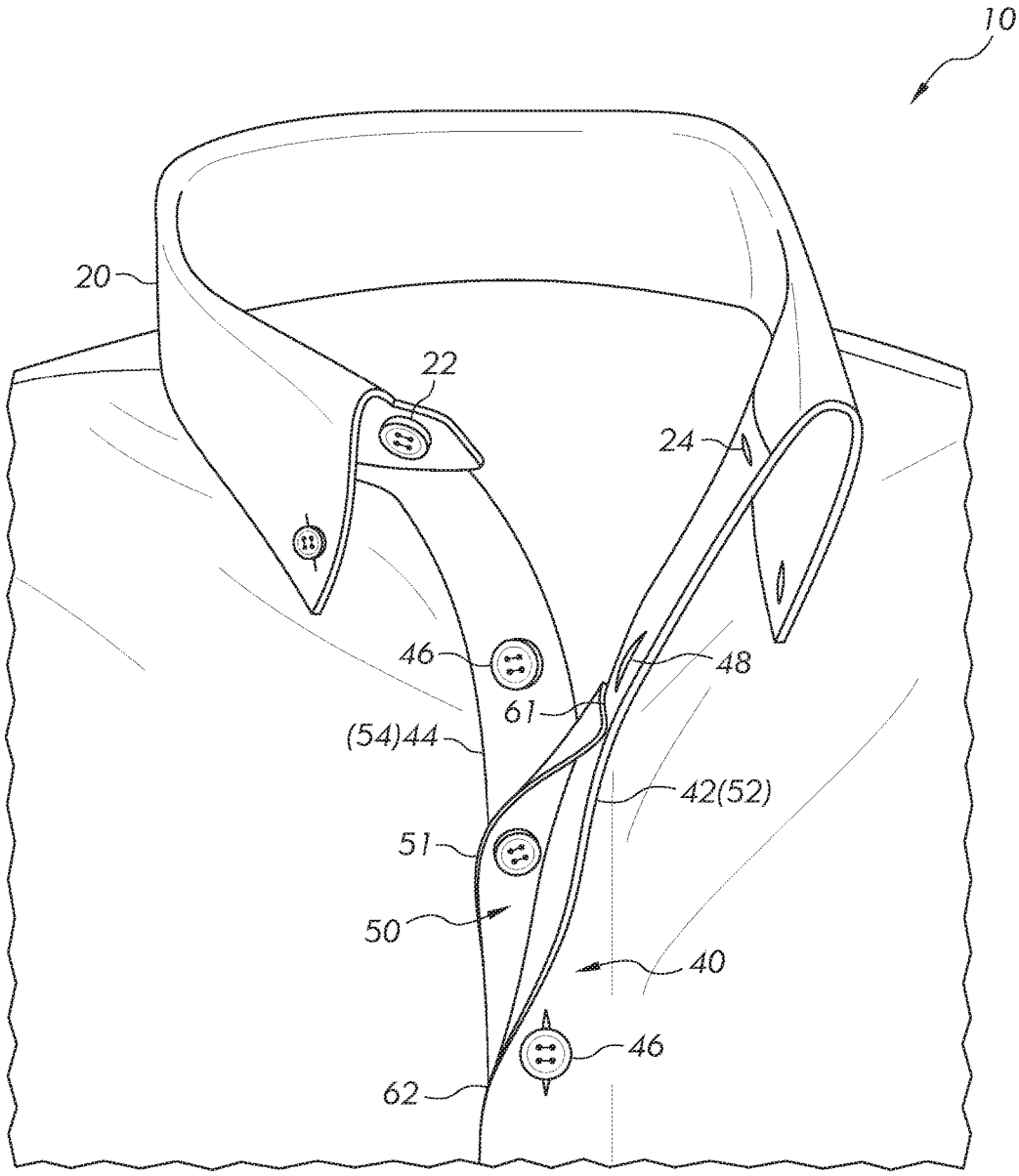

Illustrated in the accompanying drawing(s) is at least one of the best mode embodiments of the present invention In such drawing(s):

FIG. 1 illustrates a garment according to an embodiment of the present invention; and FIG. 2 illustrates a garment showing a hidden portion of a placket according to an embodiment of the present invention.

DETAILED DESCRIPTION OF THE PREFERRED EMBODIMENTS

The above described drawing figures illustrate the described invention in at least one of its preferred, best mode embodiment, which is further defined in detail in the following description. Those having ordinary skill in the art may be able to make alterations and modifications to what is described herein without departing from its spirit and scope. While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. Therefore, it should be understood that what is illustrated is set forth only for the purposes of example and should not be taken as a limitation on the scope of the present invention.

FIG. 1 illustrates an exemplary garment 10 in accordance with at least one preferred embodiment.

The garment (for example, a shirt or blouse) comprises a collar 20 and a placket 40 extending therefrom, permitting a user to don the garment with substantial ease. Preferably, the placket extends the entire length of the shirt, but it may also extend only a portion of the shirt. Indeed, in embodiments where the placket extends only a portion of the shirt, it is preferable that the placket extends the upper portion of the shirt, as defined by the user's chest area while in use.

The placket comprises a top piece 42 that overlays a bottom piece 44, the bottom piece having a plurality of spaced apart exposed buttons 46 for removably engaging correspondingly spaced apart button holes 48 of the top piece. Thus, the top and bottom pieces may be disengaged so that the user may easily don the shirt, and then reengaged to close the shirt. In some embodiments, the collar may also include one or more collar buttons 22 and corresponding button holes 24. Importantly, the exposed buttons and the collar buttons, when engaged with their respective button holes, are exposed through the button holes of the top piece and therefore are plainly visible to an observer.

The plurality of buttons includes at least a first and a second button, and corresponding button holes. The first button is the button located closest to the collar, while the second button is the next closest. Neither the first nor the second button is located on the collar.

As shown in FIG. 2, the placket further comprises a hidden portion 50 located between the first and second button holes and consisting of a fly-front for concealing an intermediate button 56 when the shirt is closed. In some embodiments, the intermediate button is located at the midpoint between the first and second buttons. In some embodiments, the intermediate button has a diameter that is less than the diameter of the first and second buttons.

Preferably, the hidden portion consists of the top piece 52 (42) overlaying an intermediate piece 51 between the first and second buttons (or button holes) so as to form a pocket therebetween. A hidden button hole (not shown) is preferably located on the intermediate piece for removably engaging the intermediate button. However, the top piece preferably lacks a corresponding button hole for the intermediate button and therefore covers the engaged hidden button from view. The top and intermediate pieces may overlay the bottom piece 54 (44), which includes the intermediate button, so as to permit the intermediate button to engage the hidden button hole as described herein. In at least one embodiment, the hidden portion does not extend beyond the first and second button holes and is located solely therebetween.

In some embodiments, only a single hidden portion 51 is provided. The hidden portion 51 may be located at the mid-point between the first and second buttons 46, and may consist of a strip of placket material (i.e., the intermediate piece 51), preferably cloth, affixed at either longitudinal ends 61 and 62 to the inner surface of the top piece.

The enablements described in detail above are considered novel over the prior art of record and are considered critical to the operation of at least one aspect of the invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that the named inventor believes that the claimed subject matter is what is intended to be patented.

What is claimed is:

1. A button down shirt having a collar, the shirt having a length and a placket extending the entire length of the shirt, said placket comprising:

a bottom piece with an attached collar button, an attached first button spaced apart from the collar button and below the collar button, and an attached second button spaced apart from the first button and below the first button, wherein the collar button, first button, and second button are substantially the same size; and a top piece that substantially overlays the bottom piece when worn, wherein the top piece defines a collar button hole that corresponds to the collar button, a first button hole that corresponds to the first button, and a second button hole that corresponds to the second button, wherein the bottom piece further includes a single intermediate button located in between the first and second buttons, the intermediate button being smaller than the collar button, first button, and second button, and wherein the top piece further comprises a single hidden intermediate piece comprising a strip of placket material having first and second longitudinal ends, each of the first and second longitudinal ends being affixed to an inner surface of the top piece in between the first and second buttons, the intermediate piece and the inner surface of the top piece forming a pocket there between, wherein the hidden intermediate piece defines a single intermediate button hole to receive the intermediate button, and wherein the intermediate button is located at a midpoint between the first and second buttons.

* * * * *